US005433001A

United States Patent [19]

Tsuchiya et al.

[11] Patent Number: 5,433,001

[45] Date of Patent: Jul. 18, 1995

[54] METHOD OF PRODUCING PISTON RING

[75] Inventors: Takeshi Tsuchiya; Shuji Sameshima; Yoshio Onodera; Satoshi Kawashima, all of Yono, Japan

[73] Assignee: Nippon Piston Ring Co., Ltd., Japan

[21] Appl. No.: 978,233

[22] Filed: Nov. 20, 1992

[30] Foreign Application Priority Data

Nov. 25, 1991 [JP] Japan ..... 3-309114

[51] Int. Cl.[6] ..... B23P 15/00

[52] U.S. Cl. ..... 29/888.074; 29/557; 29/888.07

[58] Field of Search ..... 29/888.07, 888.074, 29/557; 148/16.6

[56] References Cited

U.S. PATENT DOCUMENTS

| | | | |
|---|---|---|---|
| 1,788,697 | 1/1931 | Williams et al. | 29/888.07 |
| 2,390,417 | 12/1945 | Bramberry | 29/888.07 |
| 3,870,572 | 3/1975 | Brugger et al. . | |
| 4,519,853 | 12/1985 | Kostelitz et al. . | |
| 4,531,985 | 7/1985 | Tommis | 29/888.07 |

FOREIGN PATENT DOCUMENTS

| | | | |
|---|---|---|---|
| 1499711 | 2/1978 | United Kingdom . | |
| 1522447 | 8/1978 | United Kingdom . | |
| 2035381 | 6/1980 | United Kingdom . | |
| 2153965 | 8/1985 | United Kingdom | 29/888.07 |
| 2155588 | 9/1985 | United Kingdom . | |
| 0311720 | 8/1971 | U.S.S.R. | 29/888.074 |
| 0715277 | 2/1980 | U.S.S.R. | 29/888.07 |
| 92/00397 | 9/1992 | WIPO . | |

*Primary Examiner*—Irene Cuda

*Attorney, Agent, or Firm*—Parkhurst, Wendel & Rossi

[57] ABSTRACT

A method of producing a piston ring to be incorporated in an internal combustion engine includes first nitriding surfaces of a steel base material in a high temperature range and then continuously nitriding in a low temperature range. Finally a porous layer of at least a sliding surface is removed to expose a diffusion layer under the porous layer.

11 Claims, 4 Drawing Sheets

METHOD OF PRODUCING PISTON RING

BACKGROUND OF THE INVENTION

This invention relates to a method of producing a piston ring to be incorporated in an internal combustion engine, and more particularly, to a method of producing a steel piston ring such as a steel compression ring.

Internal combustion engines including those supercharged have been improved for high speed, while having a high compression ratio according to user's needs. Therefore, it is also required to improve the piston ring such as the compression ring incorporated in the internal combustion engine.

An unleaded fuel is widely used for the internal combustion engine because of an air pollution problem. However, a leaded fuel is still used for the internal combustion engine in many countries. In a cylinder of the internal combustion engine supplied with the leaded fuel oil, hydrochloric acid gas and sulfuric acid gas create a strongly corrosive atmosphere. Accordingly, in the conventional piston ring plated with a chrome, a chromium plating of a sliding surface of the conventional piston ring is remarkably worn away. To overcome this problem it has been known to plate thickly with chrome the piston ring to prevent the sliding surface from wearing. However, such a solution is costly.

An improvement in wear resistance and corrosion resistance of the piston ring is eagerly required at present. For this purpose, the sliding surface of the piston ring is subjected to a nitriding treatment.

FIG. 7 shows a part of a conventional compression ring 1 as a piston ring. As shown in FIG. 7, a surface of a steel base material 2 is provided with a nitrided layer 3 formed by a nitriding treatment. When the nitrided layer 3 is formed by nitriding, a very fragile porous layer called a "white layer" is formed on a surface portion of the nitrided layer 3. The fragile porous layer on the surface portion of the sliding surface 4 or on both side surfaces and the sliding surface 4 is removed during a successive steps, and then a product of the piston ring can be finished.

A first example of materials composing the steel base material 2 will be described hereunder. The materials are described by weight percent.

C (Carbon): 0.80–0.95
Si (Silicon): 0.35–0.50
Mn (Manganese): 0.25–0.40
Cr (Chromium): 17.00–18.00
Mo (Molybdenum): 1.00–1.25
V (Vanadium): 0.08–0.15
Fe (Iron): Remaining percent
Unavoidable impurity material: Trace A second example of the materials is as follows.

C: 0.87–0.93
Si: 0.20–0.40
Mn: 0.20–0.40
Cr: 21.00–22.00
Mo: 0.20–0.40
Ni (Nickel): 0.90–1.10
Fe: Remaining percent
Unavoidable impurity material: Trace The compression ring 1 is incorporated in the internal combustion engine, so as to be placed in a groove formed on a piston of the internal combustion engine. While the internal combustion engine is operated, the compression ring 1 in the piston's groove repeatedly expands and shrinks along a radial direction and repeatedly strikes against a wall of the groove. Accordingly, sometimes the nitrided layer 3 of the sliding surface 4 has cracks 5. If the cracks 5 grow, a part of the nitrided layer 3 flakes away thereby generating a flaking portion 6 on the sliding surface 4. This phenomenon causes a scuffing (extraordinary abrasion), and the compression ring 1 is broken in some cases.

SUMMARY OF THE INVENTION

Accordingly, an object of the present invention is to substantially eliminate defects or drawbacks encountered in the prior art and to provide a method of producing a piston ring having a nitrided layer which has an improved cracking resistance, better wear resistance and break resistance.

This object can be achieved according to the present invention by providing a method of producing a piston ring such as a compression ring, the method comprising: a first step in which a surface of a steel base material is nitrided in a high temperature range; a second step in which the surface is continuously nitrided in a low temperature range; and a third step in which a porous layer of at least a sliding surface is removed to expose a diffusion layer under the porous layer.

A reason why the surface of the steel base material is nitrided in the high temperature range and continuously in the low temperature range is that the surface layer of the steel base material lacks nitrogen during the high temperature nitriding treatment, and the surface layer must be continuously nitrided in the low temperature range in order to infiltrate and supply the nitrogen into the surface layer.

In preferred embodiments, the method further comprises a fourth step in which a plated layer, a sprayed layer or an ion plating layer is formed on a surface of the exposed diffusion layer.

Preferably, the high temperature range for nitriding is 560° C.±5° C. to 600° C.±5° C.; the low temperature range for nitriding is 500° C.±5° C. to 550° C.±5° C.; and a difference between the low and high temperatures for nitriding is not less than 1° C.

An upper reference temperature range for nitriding in the low temperature range is preferably 545° C. to 554° C.

A rate of a nitriding time of high temperature to a whole nitriding time is limited to approximately 50% and over.

The steel base material may consist of (in wt. %): 0.83 C, 0.42 Si, 0.30 Mn, 17.50 Cr, 1.03 Mo, 0.09 V, the remainder Fe and a trace of impurities. Alternatively the steel base material may consist of 0.91 C, 0.30 Si, 0.29 Mn, 21.63 Cr, 0.30 Mo, 0.99 Ni, the remainder Fe and a trace of impurities.

BRIEF DESCRIPTION OF THE DRAWINGS

In the accompanying drawings:

FIG. 1 is a sectional view showing a steel base material of a steel compression ring;

FIG. 2 is a sectional view showing the steel compression ring nitrided on the steel base material of the steel compression ring shown in FIG. 1;

FIG. 3 is a graph representing a relation between a depth from a surface of the piston ring and a hardness of a position of the depth;

FIG. 4 is a schematic view showing a method of a TEST F;

FIG. 5 is a graph representing a relation between a displacement and a load in respect of the TEST F;

FIG. 6 is a graph representing a result of the TEST F; and

DESCRIPTION OF THE PREFERRED EMBODIMENTS

The present invention will now be described with reference to the accompanying drawings which show a method of producing a piston ring.

Figure 1:
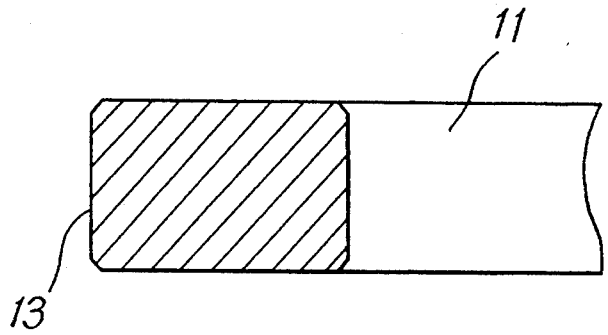
FIGS. 1 through 6 show one embodiment of the present invention.
Figure 2:
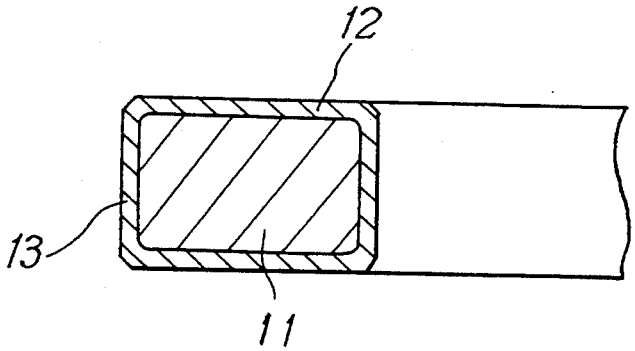

FIGS. 1 and 2 show one embodiment of this invention. For example, this invention is adapted for use as a compression ring of a set of piston rings. FIG. 1 shows a section of a steel base material 11 of a steel compression ring. As shown in FIG. 2, a nitrided layer 12 is formed on the whole surface of the steel base material 11 of the steel compression ring. In the present embodiment, the surface of the steel base material 11 is first nitrided in a high temperature range and then continuously nitrided in a low temperature range. Finally a porous layer of at least a sliding surface 13 is removed to expose a diffusion layer under the porous layer.

The porous layer, which is also called "a white layer", is formed on a surface portion of the nitrided layer 12 and is very fragile like a porous layer formed during a conventional nitriding treatment in which the temperature is constant and not changed. In this embodiment, the very fragile porous layer is removed from the whole surface including the sliding surface 13 to finish a product of the compression ring.

The high temperature range for nitriding the surface of the steel base material 11 is preferably 560° C.±5° C. to 600° C.±5° C. The surface of the steel base material 11 is nitrided at a high temperature described above because nitrogen can strongly infiltrate into the steel base material 11 at such a temperature. Therefore, a diffused layer wherein the nitrogen has diffused into and has hardened can be deeply formed. Further, a time for nitriding can be relatively short. The reason why the temperature range for nitriding is 560° C.±5° C. (lower limit temperature) to 600° C.±5° C. (upper limit temperature) is that the time required for deeply forming the diffused and hardened layer is long when the temperature range for nitriding is less than 560° C.±5° C. On the other hand, a predetermined hardness of the layer cannot be obtained and a wear resistance of the layer is insufficient when the temperature range for nitriding is more than 600° C.±5° C. For these reasons, the temperature range described above for nitrating of this invention is preferable.

The low temperature range for nitriding the surface of the steel base material 11 is preferably 500° C.±5° C. (lower limit temperature) to 550° C.±5° C. (upper limit temperature). It is possible to nitride the surfaces under the temperature range of 500° C.±5° C., but it takes a long time to form the diffused and hardened layer having a predetermined depth after nitriding in the high temperature range, and therefore productivity is low and a cost for production is high.

An upper limit temperature range for nitriding in the low temperature range is more preferably 545° C. to 554° C. instead of the temperature range of 550° C.±5° C. Because it is necessary to provide at least a 1° C. difference between the selected temperatures for nitriding in the low and high temperature ranges when the surfaces of the steel base material 11 are nitrided at a high temperature and are then continuously nitrided at a low temperature.

Each tolerance of the temperature of ±5° C. for nitriding at the high and the low temperatures is caused by a distribution of an internal temperature of a furnace for nitriding.

Next, it will be described hereunder the reason why the surface of the steel base material 11 is nitrided in the high temperature range and then is continuously nitrided in the low temperature range.

First, the nitriding treatment in the high temperature range will be described. When the surface of the steel base material 11 is nitrided at a high temperature, atoms of a nitrogen continuously diffuse into the steel base material, and, at the same time, the nitrided layer comprising an iron nitride formed on the steel base material becomes thicker gradually.

Figure 3:
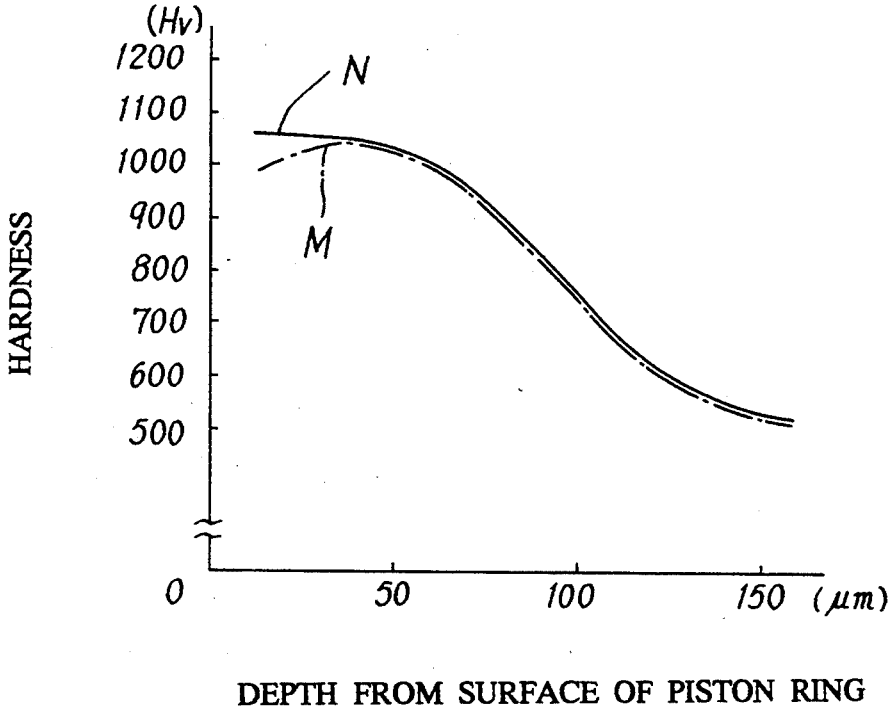

Consequently, as shown on a curved line M in FIG. 3, the nitrided layer prevents the new nitrogen from infiltrating into the steel base material and then a quantity of the new infiltrating nitrogen decreases. At a point of time, the quantity of the infiltrating nitrogen becomes less than quantity of a nitrogen diffusing into the steel base material, and therefore the quantity of the nitrogen on a surface layer is insufficient thereby slightly decreasing a hardness of the surface layer. After the nitriding in the high temperature range, the surface layer is continuously nitrided in the low temperature range in order to infiltrate and supply the new nitrogen into the surface layer lacking the nitrogen. When the steel base material is nitrided at a low temperature, a diffusion power of the nitrogen into the steel base material becomes weaker than a diffusion power of the nitrogen on which the steel base material is nitrided at a high temperature. Therefore, most of the infiltrating nitrogen remains in the surface layer and forms a nitrided material and then the hardness of the surface layer increases (see a curved line N in FIG. 3). Accordingly, if an upper limit temperature in the low temperature range becomes higher than 550° C. when the surface layer is nitrided in the low temperature range, the diffusion of the nitrogen into the steel base material is promoted and then the infiltrating nitrogen hardly remains in the surface layer. Namely, in the present invention, a wear resistance of the surface layer of the piston ring can be improved in comparison with a surface layer of a traditional piston ring.

Some examples of experiments will be described hereunder and is made in order to confirm effects of the present embodiments.

(TEST A)

Test A for a wear resistance and a cracking resistance is made by using actual piston rings.

1. Test device: Test device for wear resistance
2. Surface speed: 3.3 m/sec (800 rpm)
3. Lubricating oil: 7.5 W-30
4. Flow rate of the lubricating oil: 1 cc/min
5. Piece sliding on a test piece: Steel equivalent to FC 25
6. Test piece: Piston rings (i) Conventional piston ring (A-a) is composed of a steel base material, which consists of materials (described by weight percent) as follows, and is first nitrided in a low temperature range (500° C.×12 Hr) and then is continuously nitrided in a high temperature range (580° C.×7 Hr).

C: 0.83
Si: 0.42
Mn: 0.30
Cr: 17.50
Mo: 1.03
V: 0.09
Fe: Remaining percent
Unavoidable impurity materials: trace (ii) A piston ring (A–b) of the present invention is composed of the same steel base material as one (A–a) of the conventional piston rings described above, and is first nitrided in a high temperature range and then is continuously nitrided in a low temperature range. These temperatures and times for nitriding are described in Table 1. A very fragile porous layer formed on a surface portion of the nitrided test piece is finally removed.

7. Result: The results of Test A is shown in Table 1 hereunder.

TABLE 1

| | Conventional piston ring (A-a) | Piston ring (A-b) of the present invention | | |
|---|---|---|---|---|
| Nitriding condition | 500° C. × 12 Hr<br>580° C. × 7 Hr | 580° C. × 7 Hr<br>510° C. × 7 Hr | 580° C. × 7 Hr<br>530° C. × 5 Hr | 580° C. × 7 Hr<br>550° C. × 4 Hr |
| Rate of nitriding time of high temperature to whole nitriding time | — | 50% | 58.3% | 63.6% |
| Critical load for generating cracks | 50 kgf | 60 kgf | 60 kgf | 60 kgf |

As shown in Table 1, the critical loads of the piston ring of the present invention are larger than the critical load of the conventional piston ring. Namely, according to the present invention, the cracking resistance of the piston rings can be improved.

(TEST B)

Test B for the wear resistance and the cracking resistance is made by using actual piston rings. Conditions of this Test B are the same as Test A except composition of a steel base material of a test piece for Test B.

1. Test device: Test device for the wear resistance
2. Surface speed: 3.3 m/sec. (800 rpm)
3. Lubricating oil: 7.5 W–30
4. Flow rate of the lubricating oil: 1 cc/min
5. Piece sliding on the test piece: Steel equivalent to FC 25
6. Test piece: Piston rings (i) Conventional piston ring (B–a) is composed of a steel base material, which consists of materials (described by weight percent) as follows, and is first nitrided in a low temperature range (500° C.×12 Hr) and then is continuously nitrided in a high temperature range (580° C.×7 Hr) like Test A.

C: 0.91
Si: 0.30
Mn: 0.29
Cr: 21.63
Mo: 0.30
Ni (Nickel): 0.99
Fe: Remaining percent
Unavoidable impurity materials: Trace (ii) A piston ring (B–b) of the present invention is composed of the same steel base material as one (B–a) of the conventional piston ring of Test B, and is first nitrided in a high temperature range and then is continuously nitrided in a low temperature range. These temperatures and times for nitriding are described in Table 2. The very fragile porous layer formed on the surface portion of the nitrided test piece is finally removed.

7. Result: The results of Test B is shown in Table 2 hereunder.

TABLE 2

| | Conventional piston ring (B-a) | Piston ring (B-b) of the present invention | | |
|---|---|---|---|---|
| Nitriding condition | 500° C. × 12 Hr<br>580° C. × 7 Hr | 580° C. × 8 Hr<br>510° C. × 7 Hr | 580° C. × 8 Hr<br>530° C. × 5 Hr | 580° C. × 8 Hr<br>550° C. × 4 Hr |
| Rate of nitriding time of high temperature to whole nitriding time | — | 53.3% | 61.5% | 66.7% |
| Critical load for generating cracks | 40 kgf | 50 kgf | 50 kgf | 50 kgf |

As shown in Table 2, the critical loads of the piston ring of the present invention are larger than the critical load of the conventional piston ring. Namely, according to the present invention, the cracking resistance of the piston rings can be improved.

(TEST C)

Test C for the cracking resistance is made on the same conditions as Test A or Test B, but the rates of the nitriding time of high temperature to the whole nitriding time are changed.

1. Test device: Test device for the wear resistance
2. Surface speed: 3.3 m/sec (800 rpm)

3. Lubricating oil: 7.5 W-30
4. Flow rate of the lubricating oil: 1 cc/min
5. Piece sliding on a test piece: Steel equivalent to FC 25
6. Test piece: Piston rings (i) The piston ring (C-a) is composed of the steel base material, which is described hereunder and consists of same materials as the piston ring (A-a), and is nitrided in a high temperature range (580° C.×4 Hr) and then is continuously nitrided in a low temperature range (550° C.×6 Hr). The rate of the nitriding time (4 Hr) of high temperature to the whole nitriding time (4 Hr+6 Hr=10 Hr) is 40%.

C: 0.83
Si: 0.42
Mn: 0.30
Cr: 17.50
Mo: 1.03
V: 0.09
Fe: Remaining percent
Unavoidable impurity materials: Trace (ii) The piston ring (C-b) is composed of the same steel base material, described hereunder, as one (B-a) of the piston ring of Test B and is nitrided in the high temperature range (580° C.×5 Hr) and then is continuously nitrided in the low temperature range (550° C.×6 Hr). The rate of the nitriding time (5 Hr) of high temperature to the whole nitriding time (5 Hr+6 Hr=11 Hr) is 45.5%

C: 0.91
Si: 0.30
Mn: 0.29
Cr: 21.63
Mo: 0.30
Ni: 0.99
Fe: remaining percent
Unavoidable impurity materials: Trace The very fragile porous layer formed on the surface portion of the nitrided test piece is finally removed.

7. Result: The results of Test C is shown in Tables 3 and 4 hereunder.

TABLE 3

| | Conventional piston ring (A-a) of Test A | Piston ring (A-b) of Test A 580° C. × 7 Hr 550° C. × 4 Hr (63.6%) | Piston ring (C-a) of Test C 580° C. × 4 Hr 550° C. × 6 Hr (40%) |
|---|---|---|---|
| Critical load for generating cracks | 50 kgf (see Table 1) | 60 kgf (see Table 1) | 50 kgf |

TABLE 4

| | Conventional piston ring (B-a) of Test B | Piston ring (B-b) of Test B 580° C. × 8 Hr 550° C. × 4 Hr (66.7%) | Piston ring (C-b) of Test C 580° C. × 5 Hr 550° C. × 6 Hr (45.5%) |
|---|---|---|---|
| Critical load for generating cracks | 40 kgf (see Table 2) | 50 kgf (see Table 2) | 40 kgf |

As shown in Tables 3 and 4, the cracking resistance described by the critical load for generating cracks on the piston rings (C-a, C-b) of Test C becomes equal to the cracking resistance of the conventional piston rings (A-a, B-a) of Tests A and B in the case where the rate of the nitriding time of high temperature to the whole nitriding time is 40% (in the case of the piston ring (C-a)) or 45.5% (in the case of the piston ring (C-b)).

According to the result of Tests A to C, when the rate of the nitriding time is not less than approximately 50%, the cracking resistance will be improved. Therefore the rate is limited to approximately 50% and over.

(TEST D)

A durability of the piston ring of an actual engine described hereunder is tested for use with an engine and whether a crack is made on the nitrided piston ring.

1. Actual engine: Water cooled type diesel engine having four-cylinders displacing 2.8 liters
2. Test condition: 4,200 rpm×300 hours under full load
3. Test piece: Piston rings No. 1 Cylinder; Conventional piston ring (A-a) of Test A
No. 2 Cylinder; One (A-b) of piston rings of the present invention on Test A, which is nitrided in the high temperature range (580° C.×7 Hr) and then is continuously nitrided in the low temperature range (530° C.×5 Hr)
No. 3 Cylinder; Conventional piston ring (A-a) of Test A
No. 4 Cylinder; One (A-b) of piston rings of the present invention on Test A, which is nitrided in the high temperature range (580° C.×7 Hr) and then is continuously nitrided in the low temperature range (530° C.×5 Hr)

The very fragile porous layer formed on the surface portion of the nitrided test pieces is removed.

4. Result: The results of Test D is shown in Table 5 hereunder.

TABLE 5

| Cylinder | Test piece | Existence of cracks |
|---|---|---|
| No. 1 | Conventional piston ring in Test A | YES |
| No. 2 | One of piston rings of the present invention in Test A (580° C. × 7 Hr → 530° C. × 5 Hr) | NO |
| No. 3 | Conventional piston ring in Test A | YES |
| No. 4 | One of piston rings of the present invention in Test A (580° C. × 7 Hr → 530° C. × 5 Hr) | NO |

As shown in Table 5, some cracks exist on the conventional piston rings of Test A (see Nos. 1 and 3 cylinders), but do not exist on the piston rings of the present invention in Test A (see Nos. 2 and 4 cylinders).

(TEST E)

Durability of piston rings is evaluated utilizing the same actual engine as Test D under the same conditions as Test D but test pieces are changed. It is observed whether a crack occurs on the nitrided piston ring.

1. Actual engine: Water cooled type diesel engine having four-cylinders of 2.8 liter
2. Test condition: 4,200 rpm×300 hours under full load
3. Test piece: Piston rings No. 1 Cylinder; Conventional piston ring (B-a) of Test B
No. 2 Cylinder; One (B-b) of piston rings of the present invention in Test B, which is nitrided in the high temperature range (580° C.×8 Hr) and then is continuously nitrided in the low temperature range (530° C.×5 Hr)

No. 3 Cylinder; Conventional piston ring (B–a) of Test B

No. 4 Cylinder; One (B–b) of piston rings of the present invention in Test B, which is nitrided in the high temperature range (580° C.×8 Hr) and then is continuously nitrided in the low temperature range (530° C.×5 Hr)

The very fragile porous layer formed on the surface portion of the nitrided test piece is removed.

4. Result: The result of Test E is shown in Table 6 hereunder.

TABLE 6

| Cylinder | Test piece | Existence of cracks |
|---|---|---|
| No. 1 | Conventional piston ring in Test B | YES |
| No. 2 | One of piston rings of the present invention in Test B (580° C. × 8 Hr → 530° C. × 5 Hr) | NO |
| No. 3 | Conventional piston ring in Test B | YES |
| No. 4 | One of piston rings of the present invention in Test B (580° C. × 8 Hr → 530° C. × 5 Hr) | NO |

As shown in Table 6, some cracks exist on the conventional piston rings of Test B (see Nos. 1 and 3 cylinders), but do not exist on the piston rings of the present invention in Test B (see Nos. 2 and 4 cylinders).

(TEST F)

A bendability of an actual piston ring is tested by putting a load on the piston ring.

1. Test device: Test device for a bending test

Figure 4:
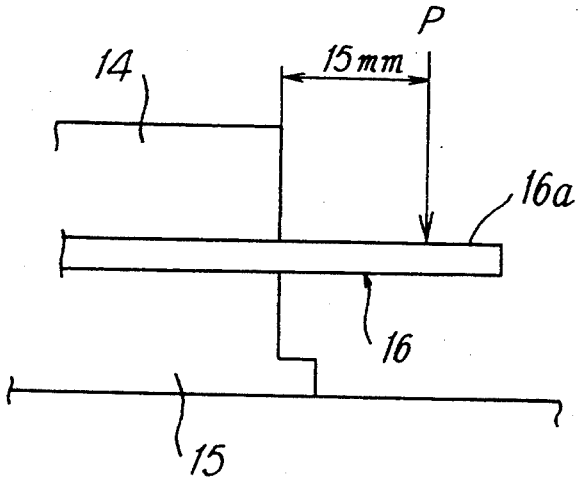

2. Method of bending test: As shown in FIG. 4, the actual piston ring product 16 or the conventional piston ring is held between presser blocks 14 and 15. A part 16*a* of the piston ring product 16 or the conventional piston ring projects out of edges of the presser blocks 14 and 15, and a load P is put on an upper surface of the projected part 16*a*. A lowering velocity of the load P is 0.5 mm/min.

Figure 5:
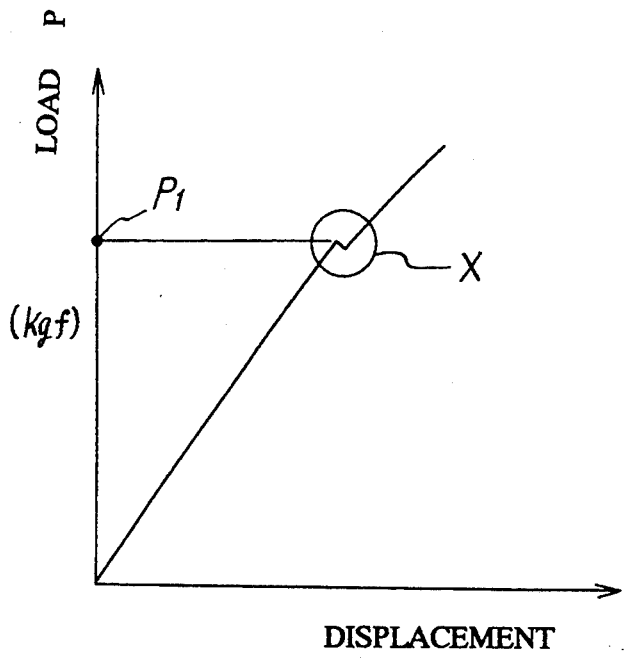

FIG. 5 shows a relation between the load P and a displacement of the projected part 16*a*. As shown in FIG. 5, if the piston ring product 16 or the conventional piston ring has cracks, the load P slightly drops (see a point "x" in FIG. 5).

Figure 6:
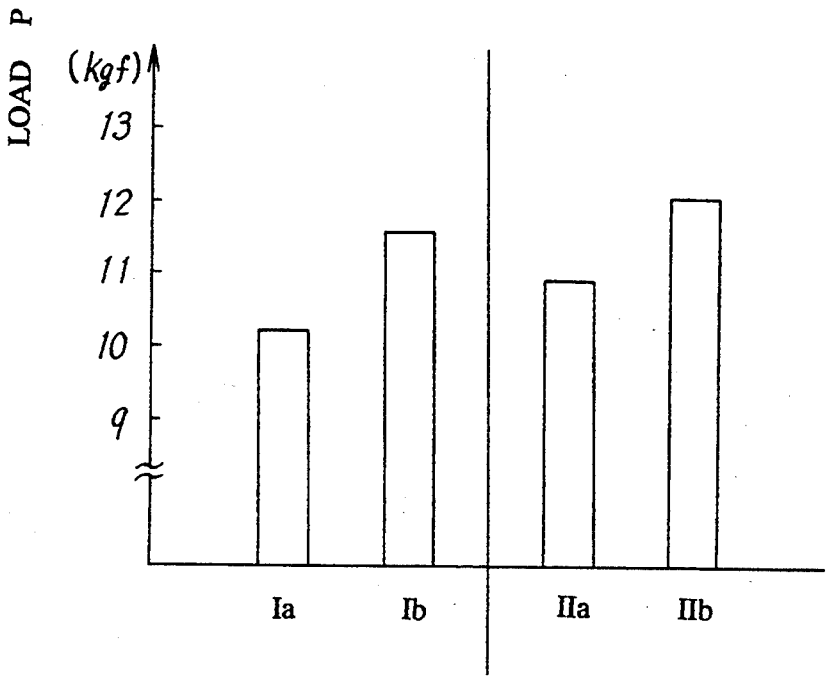
Figure 7:
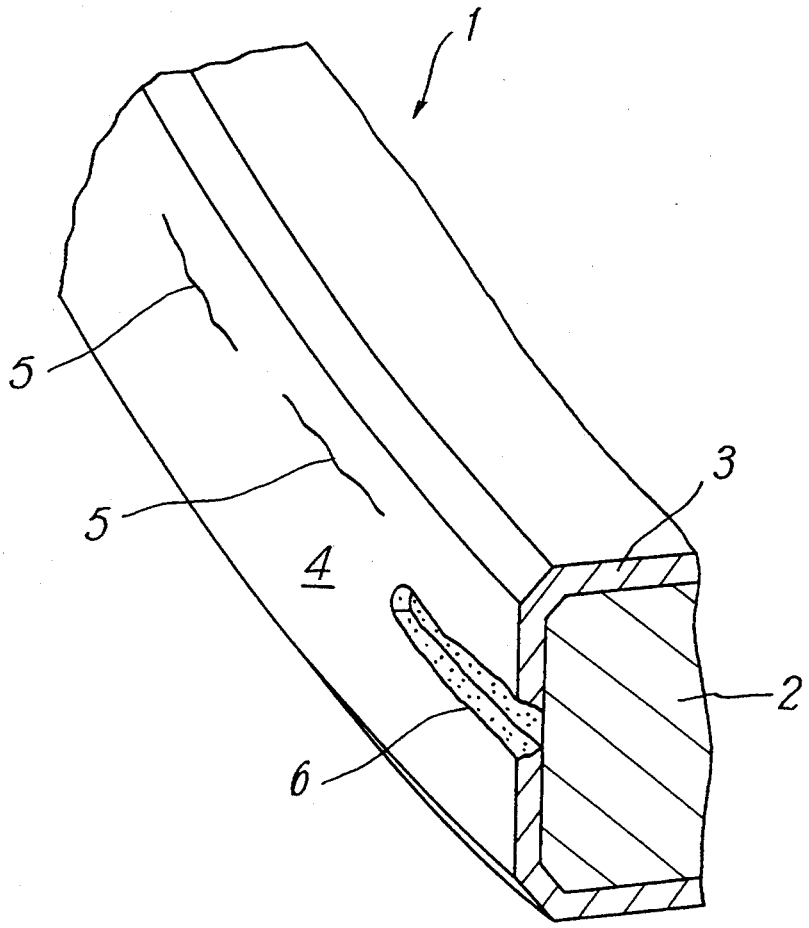
FIG. 7 is an enlarged perspective view partially showing a compression ring produced by a conventional method.

In FIG. 6, the load P at the point "x" is compared between the piston ring product 16 and the conventional piston ring.

3. Test piece

Ia: The conventional piston ring of Test A

Ib: The piston ring product of this invention of Test A

IIa: The conventional piston ring of Test B

IIb: The piston ring product of this invention of Test B

4. Result: The results of Test F is shown in FIG. 6

As shown in FIG. 6, the piston ring products Ib and IIb of this invention has cracks under the influence of a load P higher than a load under the influence of which two conventional piston rings Ia and IIa have cracks. Namely, according to this invention, the bendability resistance of the piston rings can be improved.

Preferably, on the embodiment described above, a plated layer, a sprayed layer or an ion plating layer is formed on a surface of the exposed diffusion layer of the piston ring. Therefore, a wear resistance and a corrosion resistance of the piston ring can be further improved.

As described above, according to the piston ring produced by the method of this invention, the cracking resistance, the wear resistance and the break resistance of the nitrided layer can be improved and the bendability resistance of the nitrided layer can be further improved.

What is claimed is:

1. A method of producing a piston ring having a sliding surface, said method comprising:

a first step including nitriding a surface portion of a steel base material at a first temperature within a high temperature range of 560°±5° C. to 600° C.±5° C.;

a second step including nitriding said surface portion at a second temperature within a low temperature range of 500° C.±5° C. to 550° C.±5° C., said second step being carried out after said first step, and a difference between said first and second temperatures being not less than 1° C. whereby a porous layer is formed on said surface portion; and a third step including removing at least a portion of the porous layer to expose a diffusion layer to form the sliding surface of the piston ring.

2. The method of claim 1, further comprising:

a fourth step including forming a plated layer on a surface of the exposed diffusion layer.

3. The method of claim 1, further comprising:

a fourth step including forming a sprayed layer on a surface of the exposed diffusion layer.

4. The method of claim 1, further comprising:

a fourth step including forming an ion plating layer on a surface of the exposed diffusion layer.

5. The method of claim 1, wherein said steel base material consists of:

0.91 wt. % C,
0.30 wt. % Si,
0.29 wt. % Mn,
21.63 wt. % Cr,
0.30 wt. % Mo,
0.99 wt. % Ni, remainder Fe and a trace of unavoidable impurity materials.

6. The method of claim 1, wherein an upper limit temperature range for nitriding in said low temperature range is 545° C. to 554° C.

7. The method of claim 1, wherein said piston ring is a compression ring.

8. The method of claim 1, wherein said porous layer is removed from the entirety of said surface portion including said sliding surface. However, such a solution is costly.

9. The method of claim 1, wherein a rate of a nitriding duration at said first temperature to the entire nitriding duration is not less than about 50%.

10. The method of claim 1, wherein said steel base material consists of:

0.83 wt. % C,
0.42 wt. % Si,
0.30 wt. % Mn,
17.50 wt. % Cr,
1.03 wt. % Mo,
0.09 wt. % V, remainder Fe and a trace unavoidable impurity materials.

11. A method of producing a piston ring having a sliding surface, comprising:

a first step including nitriding a surface portion of a steel base material at a first temperature within a high temperature range;

a second step including nitriding said surface portion at a second temperature within a low temperature range, wherein said first temperature is higher than said second temperature and said second step is carried out after said first step, whereby a porous layer is formed on said surface portion; and a third step including removing at least a portion of the porous layer to expose a diffusion layer to form the sliding surface of the piston ring.

* * * * *